US007410289B2

(12) United States Patent
Hill

(10) Patent No.: US 7,410,289 B2
(45) Date of Patent: Aug. 12, 2008

(54) INTERLOCKABLE WATCHWINDER

(75) Inventor: Paul D. Hill, Topanga, CA (US)

(73) Assignee: Wolf Designs, Inc., Malibu, CA (US)

( * ) Notice: Subject to any disclaimer, the term of this patent is extended or adjusted under 35 U.S.C. 154(b) by 0 days.

(21) Appl. No.: 11/385,080

(22) Filed: Mar. 21, 2006

(65) Prior Publication Data

US 2007/0223319 A1 Sep. 27, 2007

(51) Int. Cl.
*G04B 3/00* (2006.01)
*G04C 1/04* (2006.01)

(52) U.S. Cl. ..... 368/206; 81/7.5

(58) Field of Classification Search ..... 368/206, 368/207, 10; 81/7.5
See application file for complete search history.

(56) References Cited

U.S. PATENT DOCUMENTS

| | | | | |
|---|---|---|---|---|
| 1,076,116 | A | | 10/1913 | Hatfield |
| 1,736,651 | A | | 11/1929 | Glaenzer |
| 1,983,307 | A | | 12/1934 | Regenhardt |
| 2,917,955 | A | * | 12/1959 | Leger ..... 81/7.5 |
| 3,107,131 | A | | 10/1963 | Lightburn |
| 3,374,917 | A | | 3/1968 | Troy |
| 3,425,586 | A | | 2/1969 | Petters et al. |
| 3,552,817 | A | | 1/1971 | Marcolongo |
| 3,778,870 | A | | 12/1973 | Bennett |
| 3,836,218 | A | | 9/1974 | Hallal |
| 3,851,936 | A | | 12/1974 | Muller |
| 3,999,818 | A | | 12/1976 | Schankler |
| 4,003,172 | A | | 1/1977 | Pawl |
| 4,056,295 | A | | 11/1977 | Downing |
| 4,182,244 | A | | 1/1980 | Hutchins, Jr. et al. |
| 4,227,758 | A | | 10/1980 | Clare |
| 4,243,279 | A | | 1/1981 | Ackeret |
| 4,278,174 | A | | 7/1981 | LeBlanc |
| 4,372,445 | A | | 2/1983 | Keffeler |
| 4,423,913 | A | | 1/1984 | Lee |
| 4,470,647 | A | | 9/1984 | Bishoff et al. |
| 4,577,914 | A | | 3/1986 | Stravitz |
| 4,737,039 | A | | 4/1988 | Sekerich |

(Continued)

OTHER PUBLICATIONS

Wolf Designs' "Watch Rotators" catalog published Jun. 2005.

(Continued)

*Primary Examiner*—P. Austin Bradley
*Assistant Examiner*—Jeanne-Marguerite Goodwin
(74) *Attorney, Agent, or Firm*—Fulwider Patton LLP

(57) ABSTRACT

A watchwinder adapted for home use or in a retail store environment includes a horizontal dovetail groove or channel on the top, bottom and side surfaces of the watchwinder housing which cooperates with a removable interlocking bar or rail of mating dovetail shape to selectively and detachably interconnect adjacent watchwinders arranged in a vertical or side-by-side relation. The grooves preferably extend across the horizontal dimension of the watchwinder to a point short of the front of the housing for concealment purposes, and are made relatively wide in relation to the dimensions of the housing to improve rigidity of an interlocked grouping of watchwinders and to simplify assembly. Preferably, the channels are of equal size and shape and spaced equidistantly apart. An array of interlocked watchwinders can be built up to varying size and shape, and one or more of the watchwinders can be selectively removed from anywhere within the array without disturbing the others.

17 Claims, 4 Drawing Sheets

U.S. PATENT DOCUMENTS

| | | | | |
|---|---|---|---|---|
| 4,903,451 | A | 2/1990 | Gresswell | |
| 5,046,789 | A | 9/1991 | Lee | |
| 5,267,863 | A | 12/1993 | Simmons, Jr. | |
| 5,531,517 | A | 7/1996 | Alpen | |
| 5,775,046 | A | 7/1998 | Fanger et al. | |
| 5,924,778 | A | 7/1999 | TenBrink | |
| 6,050,657 | A | 4/2000 | Hiltzman | |
| D452,256 | S | 12/2001 | Wolf | |
| 6,532,878 | B2 | 3/2003 | Tidemann | |
| 6,964,513 | B1 * | 11/2005 | Agnoff | 368/206 |
| 7,025,495 | B2 * | 4/2006 | Colarieti | 368/206 |
| 2002/0070641 | A1 | 6/2002 | Ragan | |
| 2005/0254352 | A1 | 11/2005 | Wolf et al. | |
| 2005/0265129 | A1 * | 12/2005 | Agnoff | 368/206 |
| 2006/0028922 | A1 | 2/2006 | Wolf | |

OTHER PUBLICATIONS

Yahoo.com::shop.store.yahoo.com/airline/unwatwin.html; May 10, 2006.
Underwood::underwood-london.com, May 10, 2006.
EuropeanWatch.com::europeanwatch.com/watch_winder.thm, Dec. 20, 2001.
Watchwindersplus.com/tek9.asp?pg=products&specific=jocpjqn8; Mar. 20, 2003.

* cited by examiner

INTERLOCKABLE WATCHWINDER

FIELD OF THE INVENTION

This invention relates generally to watchwinders, and more particularly, to a universal watchwinder which can be used individually or as part of a re-configurable and customizable grouping of interconnected watchwinders.

BACKGROUND OF THE INVENTION

Self-winding watches have been available for many years and are known to have mechanisms for keeping the watch wound while it is being worn by a user. The automatic winding mechanism of a self-winding watch typically includes a rotary pendulum or similar mechanism that is connected through gears to the mainspring which drives the watch. When the watch is worn, the random movements of the wearer cause the pendulum to oscillate back and forth, or to spin completely about its axis, thereby winding the mainspring of the watch movement. When completely wound, the mainspring will generally have sufficient energy to run to the watch for up to 12 to 48 hours, depending on the particular type of watch.

However, it will be appreciated that when the watch is not being worn for a sufficiently long period of time, the energy in the mainspring will tend to run down or completely dissipate. Once the spring is unwound, a self-winding watch generally cannot be fully rewound in a few seconds. The task of rewinding a self-winding watch can be a major inconvenience, as it may include resetting the time, dates and numerous other functions, or "complications," each time the spring runs down. The task becomes even more cumbersome when multiple watches are involved.

Various automatic watchwinders for keeping self-winding watches wound when not in use are currently available. A typical watchwinder, or so-called watch rotator, includes a motor-driven spindle, drum or other structure adapted to hold and rotate a watch about an axis. During rotation about an axis perpendicular to the watch face, for example, the pendulum of the watch will hang downwardly under gravity, and the watch will rotate about the stationary pendulum, causing the mainspring to stay wound.

Advanced watchwinders generally include some form of programmable microprocessor and electronic circuitry for controlling the drive motor. These units typically have user controls which interact with the circuitry and allow the user to select and control a number of operational parameters, such as rotation time, number of rotations, delay time between the start of rotation or between rotation cycles, and rotation direction. Some also have a display which indicates the particular program parameters currently selected by the user.

Existing watchwinders generally are available in single rotator or multiple rotator form. Single rotator watchwinders generally include a single watch rotating mechanism permanently mounted within a housing. While compact, unobtrusive and easy to move and store, these single rotator watchwinders are limited to use with one watch at a time.

Multiple rotator watchwinders, on the other hand, generally include a plurality of watch-winding mechanisms permanently mounted within a common housing. While capable of storing and winding multiple watches simultaneously, these watch-winding mechanisms are in a permanently fixed and immoveable relationship to one another within the housing. The end user lacks flexibility to change the pre-arranged configuration of rotators within the housing or to selectively remove one or more rotators from the housing for independent use. Moreover, the additional size and weight of these multiple rotator watchwinders makes them more difficult to move or store.

For private collectors with small and stable collections of watches, these multi-rotator watchwinders are often satisfactory because they allow the collector to purchase a single unit for storing all his watches in one convenient location and for keeping those watches in a constantly wound and functional condition over an extended period of time. However, these systems are not convenient for the collector or user who has an ever-growing collection of watches (and thus constantly finds himself with a shortage of rotator capacity). They also are not convenient for the collector or user who has a need for both a single rotator watchwinder and a multiple rotator watchwinder or multiple rotator watchwinders of different size or capacity at different times. For example, these systems are not convenient for the collector or user who travels frequently for extended periods of time and wishes to bring several different watches along on the trip. If these watches are removed from the large in-home multiple rotator for any length of time, there is a risk that the mainsprings will run down while the owner is on the road, making the watches unusable until they are reset and rewound. The rotator itself is usually too large or cumbersome to pack for the trip, and even if it could be taken along, the user must choose whether to bring all his watches along with the rotator, or to leave some at home without a rotator, again running the risk of having them wind down during his absence. Travel-sized single rotator watchwinders are available, but that, of course, necessitates the purchase and maintenance of additional units, and the inconvenience of juggling and keeping track of multiple separate watchwinders on the road.

The existing multi-rotator watchwinders also are not convenient for vendors in the retail trade. A retailer who wishes to sell watchwinders to his customers currently is required to stock both single rotator watchwinders and multiple rotator watchwinders of different size and capacity in inventory to satisfy customers with different needs and tastes. The resulting inventory costs and storage space requirements can become considerable, and the retailer always is at risk of having unsold inventory in stock for long periods of time if he has misjudged consumer demands in his particular market. It would be desirable for retailers to be able to stock one design that could be used to satisfy customers looking for watchwinders with a capacity of one through a large number.

Thus, a need exists in both the home and in the retail trade for an improved watchwinder system which is capable of use as either a single rotator watchwinder or a multiple rotator watchwinder combining features and advantages of both, which in addition may be easily reconfigured by the user to vary the size or shape. of the configuration or the number of rotators used, and that may permit one or more of the rotators to be selectively removed from the unit for travel or other reasons. The present invention fulfills these and other needs.

SUMMARY OF THE INVENTION

Briefly, and in general terms, the present invention provides a universal watchwinder construction which is useable individually or as part of a re-configurable and customizable grouping of interconnected watchwinders. The groupings are relatively easy to assemble and disassemble, with only a minimum variety of basic components, and have considerable flexibility in terms of size, shape and number of watchwinders in the grouping. Moreover, the watchwinder construction of the present invention conveniently allows one or more individual watchwinders to be selectively removed from anywhere within the array of interconnected watchwinders without disturbing the rest of the array, while securely joining adjacent Watchwinders within the array for use as an integrated unit.

In accordance with a preferred aspect of the present invention, the watchwinders include a housing having an outer surface, and at least on connector disposed on the outer surface for detachably connecting adjacent watchwinders to one another. Preferably, the housing has top, bottom and side surfaces, and at least one connector is disposed on each of those surfaces. In a further preferred aspect of the invention, each of the connectors are substantially identical to one another and are spaced equidistantly apart around the sides, top and bottom surfaces of the housing.

The preferred connector is a female connector in the form of an outwardly opening horizontal channel or groove of dovetail cross-sectional shape. The channel is preferably disposed on an outer portion of the housing and extends substantially across the entire horizontal dimension of the housing to a point short of a front surface concealing it from a frontal view. The preferred channel also is relatively wide as compared to the housing dimensions in order to improve the tortional rigidity of a grouping of interconnected watchwinders and to simplify assembly for the end user.

In a further preferred aspect of the invention, separate interlocking members are provided for detachably engaging the connectors to secure adjacent watchwinders to one another in a detachable interlocked fashion. Preferably, each interlocking member is an interlocking bar or rail with oppositely disposed male portions of dovetail cross-sectional shape corresponding to the cross-sectional shape of the channels for engaging the channels in a longitudinal sliding manner.

In another aspect, the invention provides an interlocking watchwinder array, including a plurality of watchwinders, each having a housing with top, bottom, and side surfaces, said top, bottom and side surfaces each having a connector disposed thereon, whereby corresponding connectors on the watchwinder housing are vertically aligned when the watchwinders are stacked on top of one another and laterally aligned when the watchwinders are placed beside each other.

Preferably, a plurality of interlocking bars are provided for removably engaging adjacent pairs of the watchwinders when the watchwinders are placed in a side-by-side relation or in a vertical columnar relation. In preferred form, each of the connectors is a channel extending horizontally and continuously from a rear portion of the housing to a point short of the front of said housing, and each of the interlocking bars are adapted for removable sliding engagement within the horizontal channels, each bar having in cross-section a dovetail shape corresponding in shape to the cross-section of said channels.

Furthermore, the invention preferably provides that one or more of the watchwinders may be selectively removed from the array (or selectively replaced back into the array) by translating it horizontally with respect to the remainder of the array.

Other features and advantages of the invention will become apparent from the following detailed description, taken in conjunction with the accompanying drawings, which illustrate, by way of example, features of the invention.

DETAILED DESCRIPTION OF THE PREFERRED EMBODIMENTS

Figure 1:
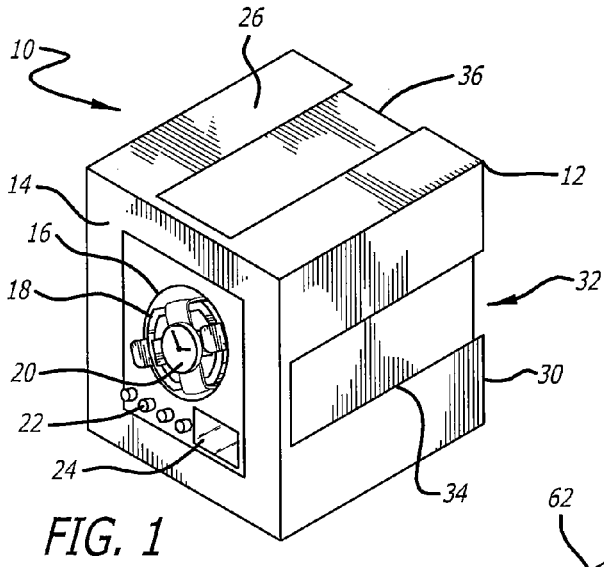
FIG. 1 is a front perspective view of a watchwinder embodying the novel features of the present invention.

As shown in the drawings, which are provided for purposes of exemplary illustration, the invention is embodied in a new and improved watchwinder 10, which is capable of being used individually or as part of a customizable and re-configurable grouping of interlocked watchwinders.

Preferably, as illustrated in FIG. 1 the watchwinder 10 includes a housing 12 of approximately cubic in form, although other shapes or forms of housing also are contemplated by the present invention. The front surface 14 of the housing 12 has an opening therein for receiving a watchwinder mechanism of conventional design. While one or more watchwinder mechanisms could be mounted in a single housing, one mechanism per housing is preferred for the present invention.

The watchwinder mechanism includes a circular, hollow drum 16, adapted to rotate on its axis, mounted within the housing 12, preferably on an upright generally vertical surface, although it is also contemplated that the front face may slope at an angle less than perpendicular to the base. A cuff 18 removably inserted within the drum 16 is adapted to hold a self-winding wristwatch 20 on the drum so that the face of the watch is visible from the front of the watchwinder 10. When the drum 16 rotates with the watch 20 and cuff 18 in place, the watch rotates within the plane of the watch face, thereby winding the self-winding mechanism of the watch.

Figure 8:
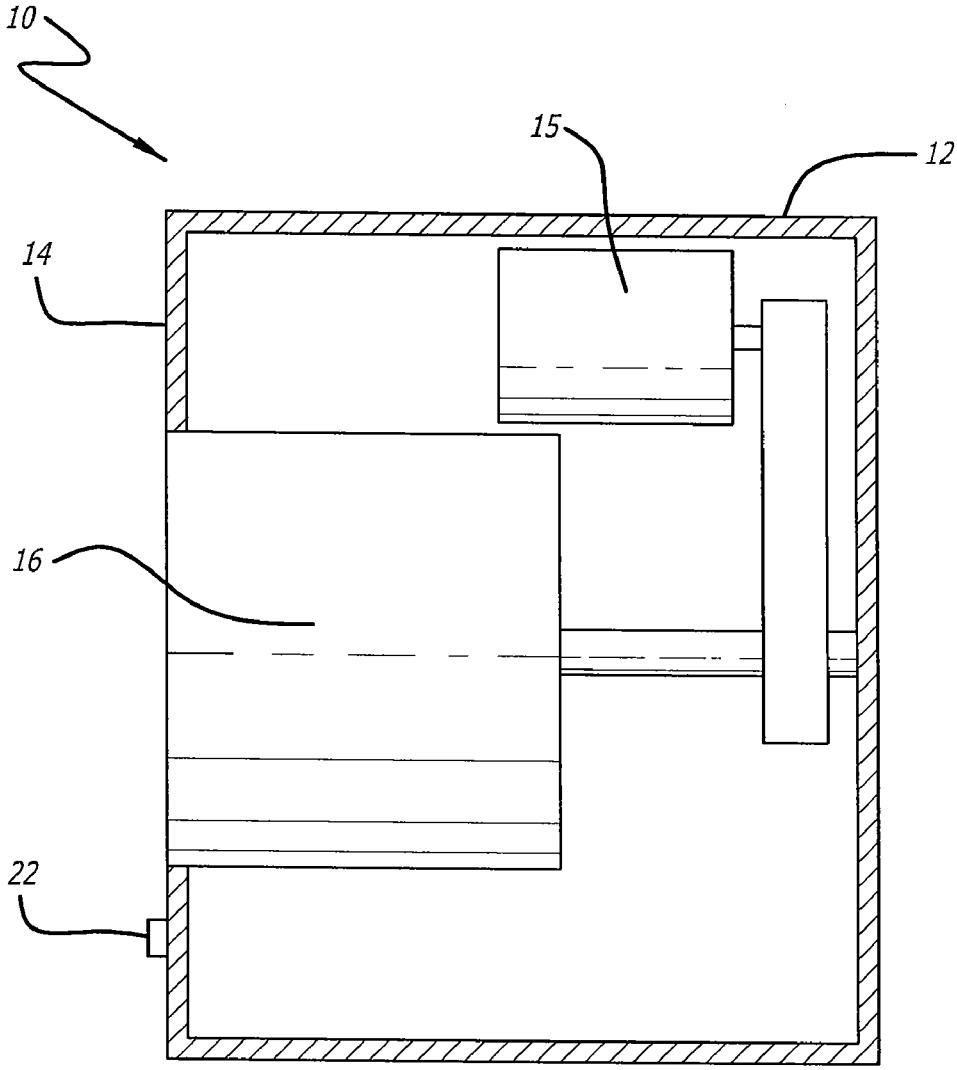
FIG. 8 is an enlarged, schematic sectional view of the watchwinder of FIG. 1, showing a motor operatively connected to the watch rotator.

In a preferred embodiment, each watchwinder 10 is powered by a small electric motor 15 and associated electronic control circuit (not shown) located within the housing 12. (See FIG. 8) The electronic circuit may be adapted to wind the watch in a first direction, to pause, and then wind the watch in a second direction with each rotation being performed for a pre-determined number of cycles. Various modes of rotation, controlled by the circuit, also may be selected by setting control buttons 22 on the front face 14 of the watchwinder 10. In a preferred embodiment, four settings are provided, namely off, clockwise rotation, anti-clockwise rotation, and reversing rotation— that is, clockwise followed by anti-clockwise rotation and so on repeating. Preferably, each watchwinder 10 will be separately powered by its own battery power supply placed in a removable drawer (not shown) in the rear of the housing 12. A typical watchwinder 10 is illustrated and described in my co-pending U.S. application Ser. No. 10/845,463, filed May 12, 2004, now Patent Application Publication No. 2005/0254352.

It is preferred that at least the top 26, bottom 28, and side surfaces 30 of the housing 12 are formed as a one-piece molded plastic part.

Preferably, the front 14 of the watchwinder 10 is left open to allow the user direct access to the drum 16 and control buttons 22. However, a hinged protective glass cover or glass-front door (not shown) may be provided, if desired.

In accordance with the present invention, a connector 32 is provided on at least one surface of the housing 12, and preferably on the sides 30, top 26 and bottom 28 surfaces of the housing 12, to permit adjacent watchwinders of like construction to be securely and detachably interlocked with each other in a side-by-side and/or vertical relationship.

Preferably, each of the connectors 32 is a female type connector affixed to the watchwinder 10, which provides the advantage that it does not protrude outwardly beyond the perimeter of the housing 12.

In a further preferred embodiment, each of the connectors 32 is an outwardly opening horizontal groove or channel 34 formed on an outer portion of each wall surface. Each channel 34 starts on the rear edge 36 of the wall surface and extends substantially continuously across the entire horizontal dimension of the wall surface to a point short of the front 14 of the housing 12. By stopping short of the front 14 of the housing 12, the channel 34 is not visible from a front view of the watchwinder 10 and does not unduly weaken the watchwinder structure.

Each horizontal groove or channel 34 is preferably undercut so as to have an inside cross-section which widens toward the interior of the watchwinder 10, thereby producing a groove of dovetail cross-sectional shape. A horizontal groove of dovetail shape is especially advantageous because it resists the separation of interconnected watchwinders 10 in a transverse direction, while permitting the watchwinders to be easily assembled and disassembled by horizontal forward and rearward sliding, in a manner to be described.

The horizontal channels 34 are preferably of equal size and shape and spaced equidistantly apart around the sides 30, top 26 and bottom 28 surfaces of the watchwinder housing 12, providing a universal watchwinder construction which may be interlocked with like watchwinders 10 arranged in a vertical or side-by-side relationship.

Preferably, each of the channels 34 is centered on the wall of the housing 12 and is made relatively wide and shallow as compared to the surface dimensions of the housing 12. A wide groove 34 helps to distribute the connecting load across a broader area which increases the tortional rigidity of a grouping of interconnected watchwinders 10 while allowing adjacent watchwinders 10 to be joined with a single interlocking bar 40 (to be described) thereby simplifying assembly for the end user. A shallow groove helps to maintain the structural integrity and sleek visual appearance of the watchwinder housing 12.

Preferably, the width of the groove 34 is approximately half or more of the width of the surface on which the groove is located. For example, in a typical watchwinder 10 with housing 12 dimensions of 12 cm W×15 cm H×10 cm D, the groove or channel 34 on the top, bottom and side surfaces would preferably be about 7 cm in width at the opening and about 8 cm in width at the deepest part. The groove depth would preferably be about 5 mm.

Figure 6:
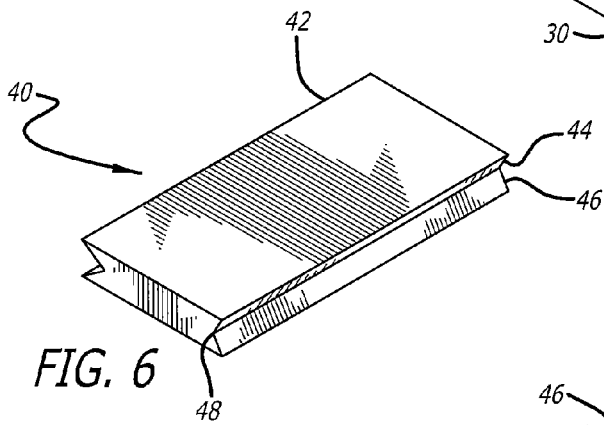
FIG. 6 is an enlarged perspective view of one of the interlocking bars shown in FIGS. 4 and 5.

Adjacent watchwinders 10 of the type described above may be connected together in a secure manner with a removable interlocking bar or rail 40 of the type shown in FIG. 6. Preferably, each of the interlocking bars 40 is adapted for longitudinal sliding engagement with the channels 34 on adjacent watchwinders 10 to form a dovetailed joint that resists being pulled apart laterally.

In a preferred form, each of the interlocking bars or rails 40 is an elongate member 42 with back-to-back oppositely disposed male attachment structures 44 and 46 of dovetail cross-sectional shape on each end which is wider than a middle section 48 and adapted to slide snugly into the channels 34 of corresponding dovetail shape. The elongate member 42 preferably has a length equal to the length of the grooves or channels on the watchwinder housing 12.

Figure 7:
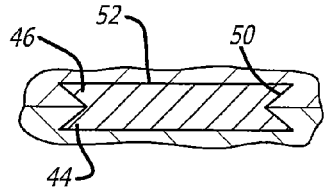
FIG. 7 is an enlarged, fragmentary, sectional view showing the interlocking bar in FIG. 6 in place for holding adjacent watchwinders together.

As shown in detail in FIG. 7, the side walls 50 of the male members 44 and 46 are angled with respect to the end surfaces 52 of the male members 44 and 46. The side walls 50 of the male members 44 and 46 and the side walls 54 of the channels 34, when joined together, thus dovetail with one another to lock the watchwinders 10 together and resist movement in a plane normal to the plane of the wall of the watchwinder, while permitting relative movement in at least one direction in the plane of the watchwinder wall.

Figure 2:
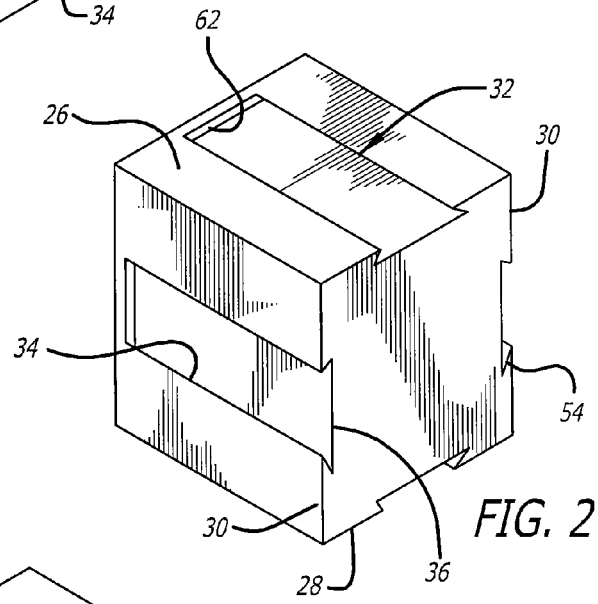
FIG. 2 is a rear perspective view of the watchwinder shown in FIG. 1.
Figure 3:
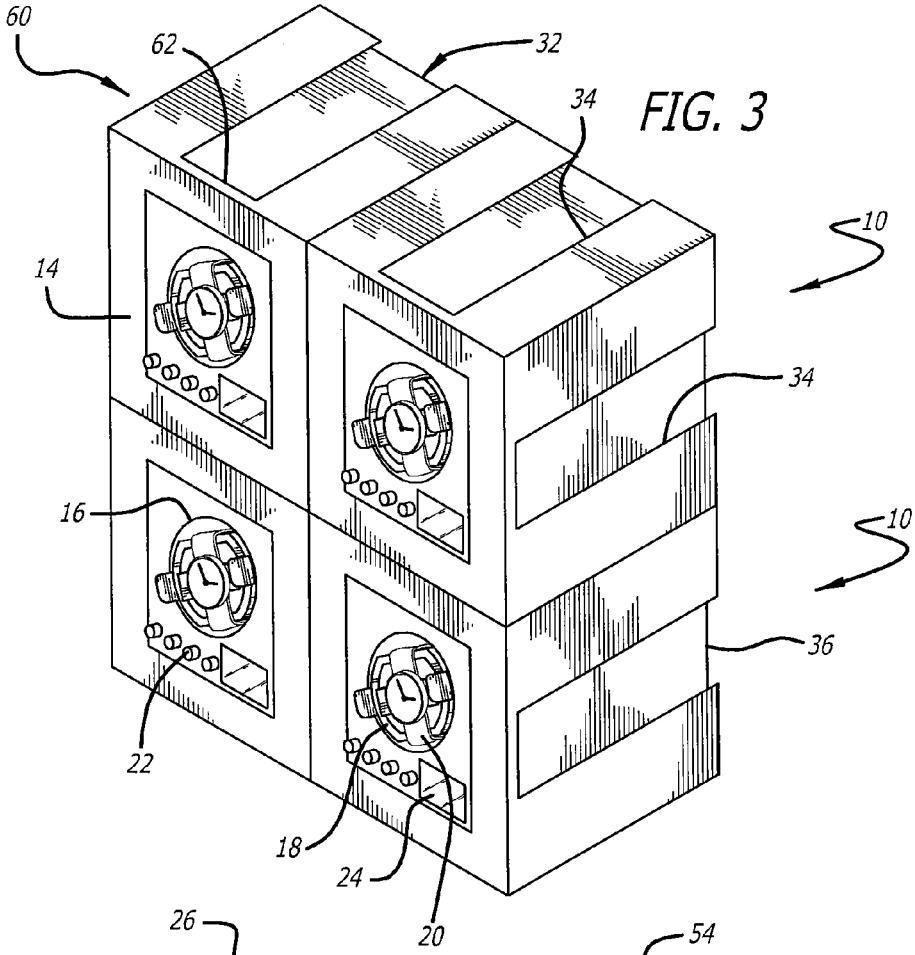
FIG. 3 is a front perspective view of an integrated array of interconnected watchwinders of the type shown in FIG. 1.
Figure 4:
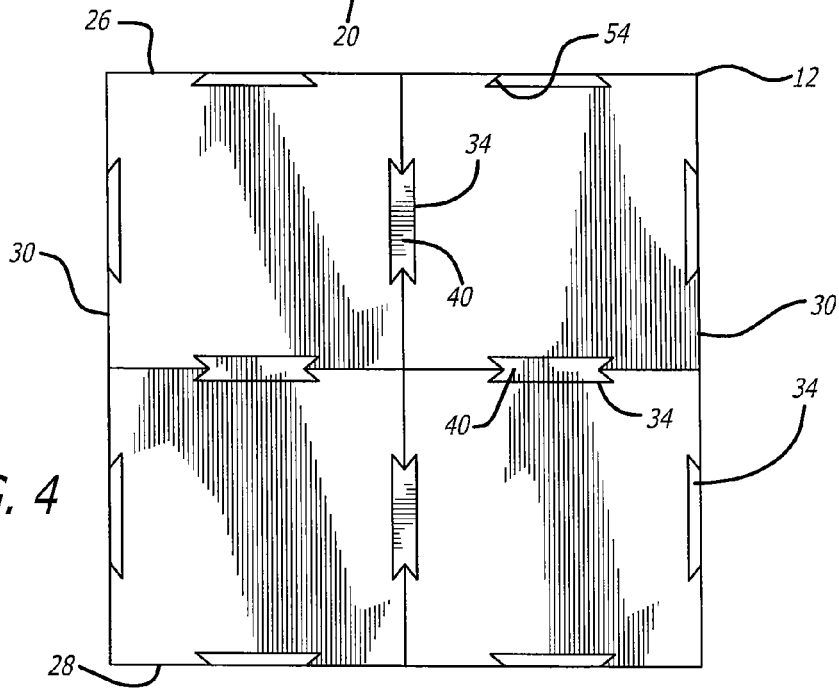
FIG. 4 is a rear elevational view of the watchwinder array shown in FIG. 3.
Figure 5:
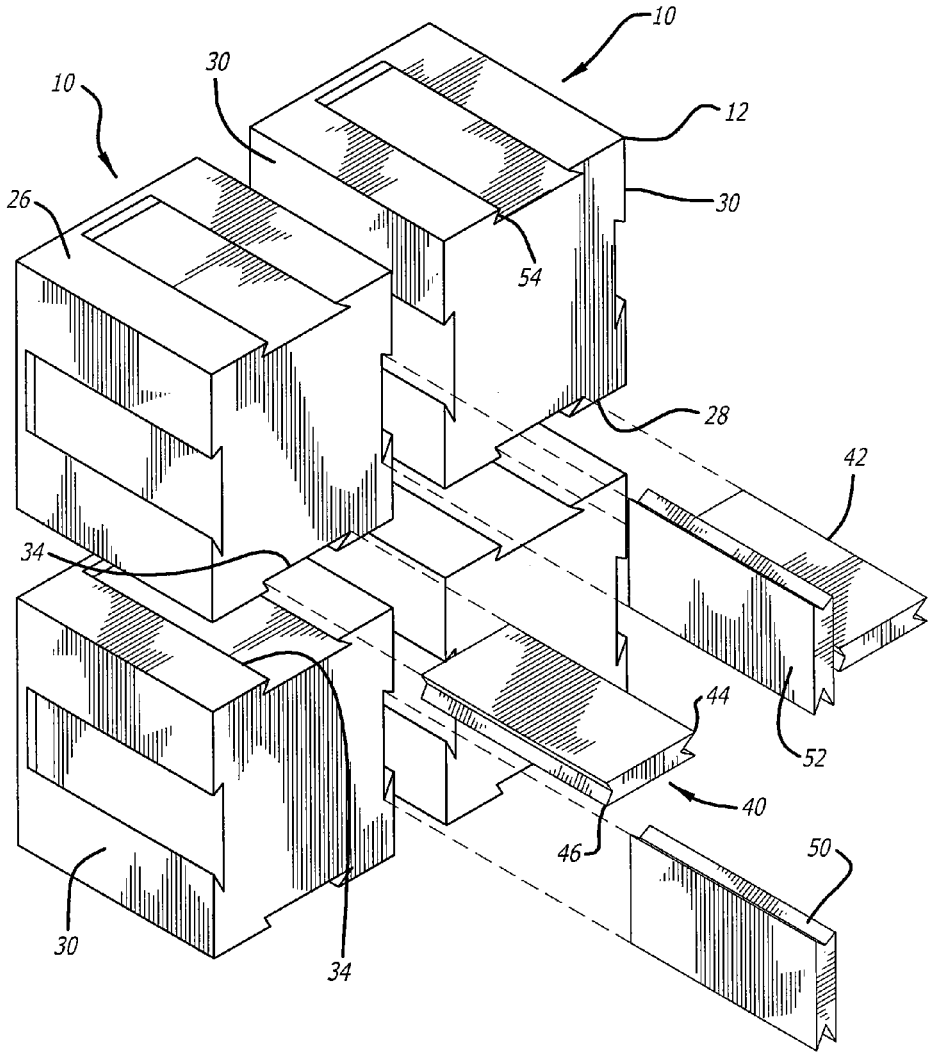
FIG. 5 is an exploded rear perspective view of the watchwinder array shown in FIGS. 3 and 4.

FIGS. 3-5 illustrate how an interlocking array 60 of watchwinders 10 may be built up using a collection of watchwinders 10 of the type shown in FIGS. 1-2.

As shown in FIGS. 3-5, the array 60 is assembled by stacking the watchwinders 10 vertically and/or by placing them side-by-side and aligning the channels 34 on adjacent watchwinders. The like, adjacent watchwinders 10 are then interlocked to one another to form an integrated unit by inserting the interlocking bars 40 of the type shown in FIG. 6, so that each male mating half 44 and 46 of the bar 40 snuggly slides into the adjacent channel 34 until the bar abuts the forward end 62 of the channel 34 the rearward end of the bar 40 is flush with the rear surface of the housing 12. The dovetail shape of the male mating members 44 and 46 snuggly engages the correspondingly shaped horizontal channels 34 ensuring that the watchwinders 10 when so mated are securely locked to one another laterally and held firmly in place.

As indicated, the interlocking bars 40 can be inserted after the watchwinders 10 are aligned or, alternatively, each bar 40 first can be inserted fully into one of a pair of adjacent watchwinders, then while the interlocking bar 40 is held stationary by hand or other means, the second adjacent watchwinder is brought into engaging alignment with the first watchwinder by sliding it horizontally rearwardly over the exposed male mating half of the interlocking bar 40 until the bar abuts the forward end 62 of the channel 34 on the second watchwinder housing.

The interlocking bars 40 could be considered as adapters in the sense that they convert the female connectors 32 on each watchwinder housing 12 into a male connector for mating with the female connectors 32 on adjacent watchwinders 10.

Either way, the entire array is given rigidity by the interlocking nature of the interlocking bars 40 in the horizontal channels 34. The integrated visual appearance of a conventional multi-rotator watchwinder is maintained since the bars 40 and channels 34 are not visible from the front of the array 60.

When assembled in this manner, the array 60 offers many of the same advantages as a conventional multi-rotator watchwinder, most notably, the ability to conveniently store and independently rotate a plurality of watches in a single integrated unit.

However, the array 60 has the additional advantage that it can be disassembled for travel, storage or other purposes by sliding each watchwinder 10 in the array 60 forwardly relative to the remainder of the array until the watchwinder is disengaged from the array. The exposed interlocking bars 40 can then be removed from the array 60 by sliding them rearwardly in a longitudinal direction.

It will be appreciated that the interlocking bars 40 can be glued or otherwise fastened in place to form a permanent assembly, if desired. However, the preferred approach is to join the bars 40 with the channels 34 without any additional fasteners or glue so as to provide a knock-down or re-configurable assembly.

While FIGS. 3-5 show four watchwinders 10 arranged in a rectangular grid pattern, it will be understood that the array can be built up to any desired size or shape and with any number of watchwinders. The size of the array or number of watchwinders within the array is virtually unlimited. The height of the array is only limited by the structural strength and weight of the watchwinders 10 themselves.

Even after initial assembly, the size or shape of an array 60, or number of watchwinders 10 in the array 60, can be altered by selectively adding or removing watchwinders 10 from the array 60, either vertically or horizontally in any chosen pattern.

Any interlocked watchwinder 10 can be removed from anywhere within the array 60 without disturbing the remainder of the array by translating the watchwinder in a forward horizontal direction with respect to the array 60, even if the watchwinder 10 is located in a central portion of the array 60 and is mated with and bridges across two or more adjacent watchwinders.

A comparison of FIGS. 1-2 with FIGS. 3-5 illustrates that the present invention allows the user to choose between a single rotator watchwinder configuration or a multi-rotator watchwinder configuration, as needed, with a minimum variety of basic components, ease of assembly and disassembly, and maximum flexibility, and with the added benefit that the multi-rotator assembly (1) is re-configurable and customizable to adapt to varying needs, (2) permits individual watchwinders to be selectively removed from anywhere within the array for any reason without disrupting the rest of the array, and (3) securely joins adjacent watchwinders to each other so that the array cannot be accidentally disturbed or disrupted and can be moved as an integral unit for storage and the like.

While several particular forms of the invention have been illustrated and described, it will be apparent that various modifications can be made without departing from the spirit and scope of the invention.

I claim:

1. A watchwinder, comprising:

a housing having an outer surface;

a watch rotator configured to rotate a self-winding watch;

a motor disposed within the housing and operatively connected to the watch rotator; and at least one connector disposed on an outer surface of the housing for detachably connecting a plurality of said watchwinders to one another, wherein said at least one connector comprises an outwardly opening horizontal channel of dovetail cross-sectional shape.

2. Apparatus as set forth in claim 1, wherein said housing has top, bottom and side surfaces, and said at least one connector comprises a plurality of connectors with at least one connector disposed on each of said top, bottom and side surfaces.

3. Apparatus as set forth in claim 2, wherein said plurality of connectors are substantially identical to each other and spaced equidistantly apart around the sides, top and bottom surfaces of said housing.

4. Apparatus as set forth in claim 1, wherein said channel is disposed on an outer portion of said housing and extends substantially the entire horizontal dimension of said housing to a point short of a front surface of said housing.

5. Apparatus as set forth in claim 1, wherein said channel had a width of about one-half or more of the width of the surface on which said channel is disposed.

6. Apparatus as set forth in claim 1, further comprising an interlocking bar having oppositely disposed male portions of dovetail cross-sectional shape corresponding to the cross-sectional shape of said channels for slidably engaging said channels in a longitudinal sliding manner to securely connect said plurality of watchwinders to one another.

7. Apparatus as set forth in claim 1, wherein said housing is formed as a one-piece molded plastic part.

8. A watchwinder, comprising:

a housing having an outer surface;

a watch rotator configured to rotate a self-winding watch;

a motor disposed within the housing and operatively connected to the watch rotator; and at least one connector disposed on an outer surface of the housing for detachably connecting a plurality of said watchwinders to one another, and further comprising an interlocking member for detachably engaging said at least one connector to secure adjacent watchwinders to one another in a detachable interlocked relation.

9. Apparatus as set forth in claim 8, wherein said interlocking member comprises a removable bar.

10. An interlocking watchwinder array, comprising:

a plurality of watchwinders, each having a housing with top, bottom, front and side surfaces, said front surface supporting a watch rotator configured to rotate a self-winding watch, said top, bottom and side surfaces each having a connector disposed thereon, whereby corresponding connectors on said watchwinder housing are vertically aligned when said watchwinders are stacked on top of one another and laterally aligned when said watchwinders are placed beside each other, and further comprising a plurality of interlocking bars, each bar removably engaging an adjacent pair of said watchwinders when said watchwinders are in a side-by-side relation and an adjacent pair of said watchwinders when said watchwinders are in a vertical columnar relation.

11. Apparatus as set forth in claim 10, wherein each connector comprises a female connector.

12. Apparatus as set forth in claim 10, wherein one of said plurality of watchwinders may be selectively removed from said array by translating said one watchwinder horizontally with respect to the remainder of the array.

13. Apparatus as set forth in claim 10, wherein a single connector is disposed on each of said top, bottom and side surfaces.

14. Apparatus as set forth in claim 10, wherein said connectors are substantially identical to each other and are spaced equidistantly apart around the sides, top and bottom of said housing.

15. An interlocking watchwinder array, comprising:

a plurality of watchwinders, each having a housing with top, bottom, front and side surfaces, said front surface supporting a watch rotator configured to rotate a self-winding watch, said top, bottom and side surfaces each having a connector disposed thereon, whereby corresponding connectors on said watchwinder housing are vertically aligned when said watchwinders are stacked on top of one another and laterally aligned when said watchwinders are placed beside each other, and wherein each of said connectors comprises a channel extending horizontally and continuously from a rear portion of said housing to a point short of the front of said housing.

16. Apparatus as set forth in claim 15, wherein said interlocking bars are adapted for removable sliding engagement within said horizontal channels, each bar having in cross-section a dovetail shape corresponding in shape to the cross-section of said channels.

17. Apparatus as set forth in claim 15, wherein each of said horizontal channels has a width of about one-half or more of the width of the surface on which said channel is disposed.

* * * * *

UNITED STATES PATENT AND TRADEMARK OFFICE

CERTIFICATE OF CORRECTION

PATENT NO. : 7,410,289 B2
APPLICATION NO. : 11/385080
DATED : August 12, 2008
INVENTOR(S) : Paul D. Hill It is certified that error appears in the above-identified patent and that said Letters Patent is hereby corrected as shown below:

Column 2, line 51, delete “shape. of” and insert --shape of--.

Signed and Sealed this

Fourth Day of November, 2008

JON W. DUDAS
*Director of the United States Patent and Trademark Office*